US006989503B2

(12) United States Patent
Wong

(10) Patent No.: US 6,989,503 B2
(45) Date of Patent: Jan. 24, 2006

(54) POWER TOOL TRIGGER ASSEMBLY

(75) Inventor: Kin Yu Wong, Chaiwan (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/805,283

(22) Filed: Mar. 22, 2004

(65) Prior Publication Data

US 2005/0205406 A1 Sep. 22, 2005

(51) Int. Cl.
*H01H 13/02* (2006.01)

(52) U.S. Cl. ..... 200/522; 200/43.16; 200/332.2

(58) Field of Classification Search ..... 200/43.11–13, 200/43.16–43.21, 318–322, 334
See application file for complete search history.

(56) References Cited

U.S. PATENT DOCUMENTS 2,928,921 A * 3/1960 Cranmore ..... 200/509
2,947,840 A * 8/1960 Park et al. ..... 200/321
3,329,789 A * 7/1967 Sahrbacker ..... 200/522
3,777,092 A * 12/1973 Yeske ..... 200/337
3,780,246 A * 12/1973 Beckering et al. ..... 200/43.17
3,829,645 A * 8/1974 Piber ..... 200/43.17
3,953,696 A * 4/1976 Reimann et al. ..... 200/522
4,180,716 A * 12/1979 Suzuki ..... 200/320
5,012,057 A * 4/1991 Inuyama ..... 200/522

* cited by examiner

*Primary Examiner*—Elvin Enad
*Assistant Examiner*—M. Fishman
(74) *Attorney, Agent, or Firm*—Leydig, Voit & Mayer, Ltd.

(57) ABSTRACT

A trigger assembly for an electric power tool includes a switch for electrical connection to the power tool for controlling operation of the power tool, and a trigger coupled with the switch for operating the switch. The trigger is pivotable about an upper end between an outer position in which the switch is open and an inner position in which the switch is closed. Also included is a locking member located adjacent the lower end of the trigger for locking the trigger in the outer position. The locking member is movable from a locking position, locking the trigger in the outer position, to an unlocking position releasing the trigger.

9 Claims, 3 Drawing Sheets

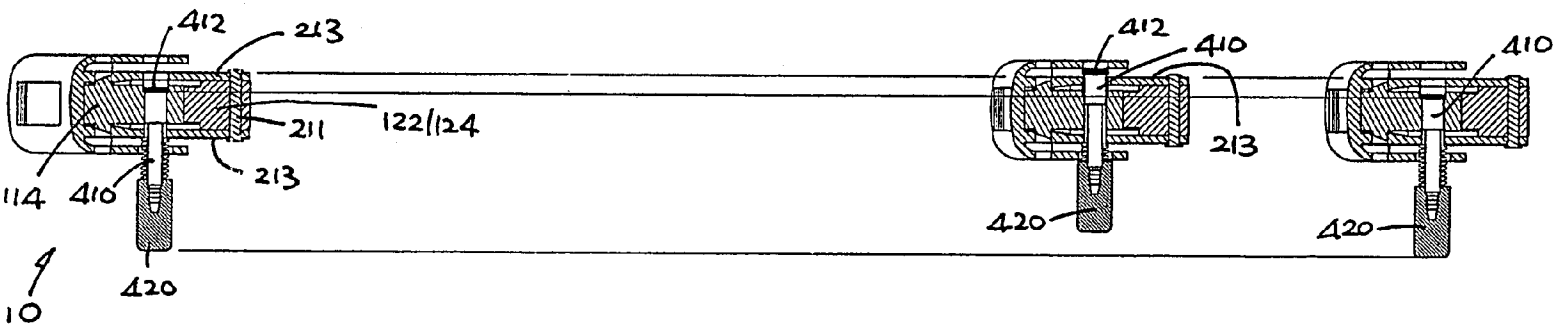
FIG. 5C
FIG. 5B
FIG. 5A
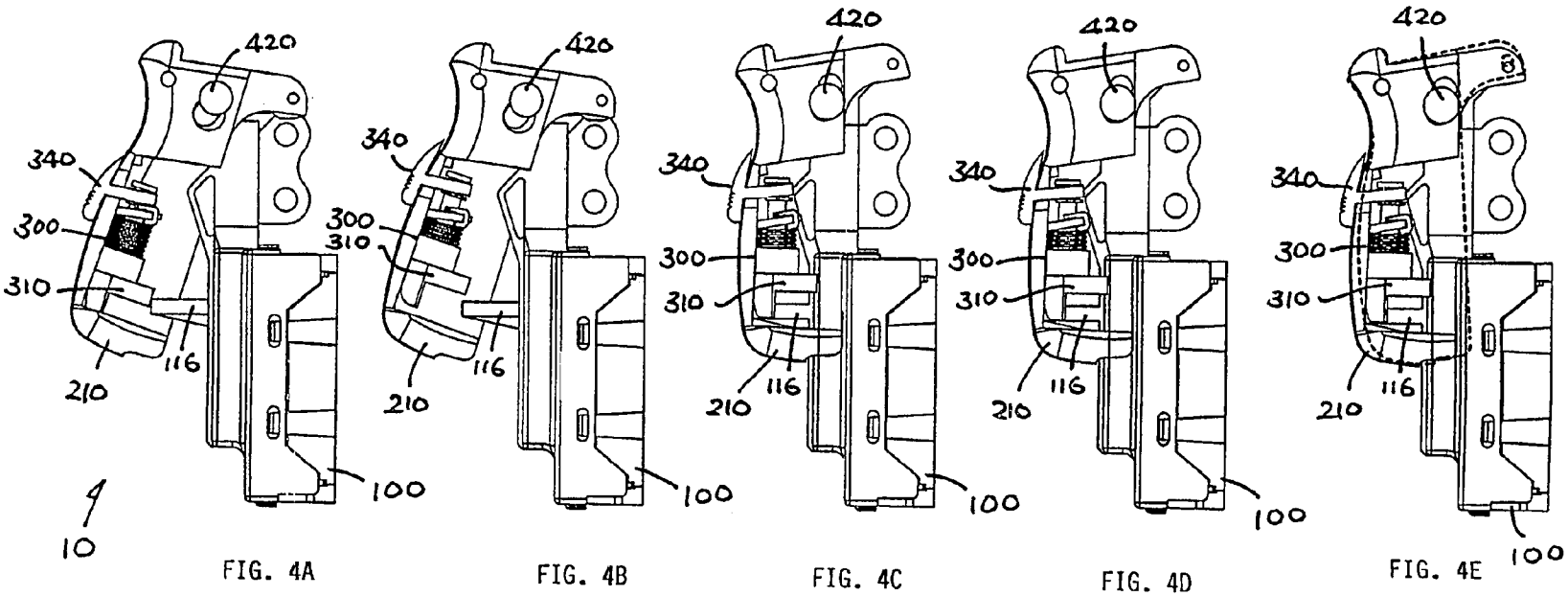
FIG. 4E
FIG. 4D
FIG. 4C
FIG. 4B
FIG. 4A

POWER TOOL TRIGGER ASSEMBLY

The present invention relates to a trigger assembly for an electric power tool.

BACKGROUND OF THE INVENTION

The speed of electric power tools is often controlled by means of a pull-trigger, which is used to switch on and off the motor as well as to adjust the motor speed/torque. The pull-trigger invariably incorporates an electrical switch for control, which is either a mechanical switch or a solid-state switch.

The invention seeks to provide an improved trigger controller.

SUMMARY OF THE INVENTION

According to the invention, there is provided a trigger assembly for an electric power tool, comprising a switch for electrical connection to said power tool for controlling its operation, and a trigger coupled with the switch for operating the switch. The trigger has upper and lower ends and is pivotable about its upper end between an outer position in which the switch is open and an inner position in which the switch is closed. Also included is a locking member provided adjacent the lower end of the trigger for locking the trigger in the outer position. The locking member is movable from a locking position locking the trigger in the outer position to an unlocking position releasing the trigger.

Preferably, the locking member is provided inside the lower trigger end.

Preferably, the locking member is carried by the lower trigger end.

It is preferred that the trigger assembly includes a spring provided inside the lower trigger end and resiliently biasing the locking member into the locking position.

It is further preferred that the trigger assembly further includes a release member accessible on the outside of the trigger and in engagement with the locking member to enable manual movement of the locking member to the unlocking position against the action of the spring.

Further more preferably, the release member is connected to the locking member by a rod on which the spring is disposed and co-acts between the locking member and the trigger.

Further more preferably, the release member comprises a knob slidably supported on the trigger.

In a preferred embodiment, the trigger assembly includes a fixture for abutment by the locking member in the locking position to thereby lock the trigger in the outer position, the locking member being manually movable to the unlocking position to avoid the fixture.

More preferably, the fixture comprises a part of a casing of the switch.

More preferably, the fixture comprises a projection substantially aligned with the locking member when the locking member is in the locking position.

For convenience of operation, the trigger assembly includes a separate releasable locking member provided adjacent the upper end of the trigger for locking the trigger in the inner position.

BRIEF DESCRIPTION OF DRAWINGS

The invention will now be more particularly described, by way of example only, with reference to the accompanying drawings, in which:

FIGS. 4A to 4E are successive side views of the trigger assembly of FIG. 2, showing its operation in sequence; and FIGS. 5A, 5B and 5C are cross-sectional top end views of the trigger assembly of FIGS. 4A, 4D and 4E, respectively.

DETAILED DESCRIPTION OF PREFERRED EMBODIMENT

Figure 2:
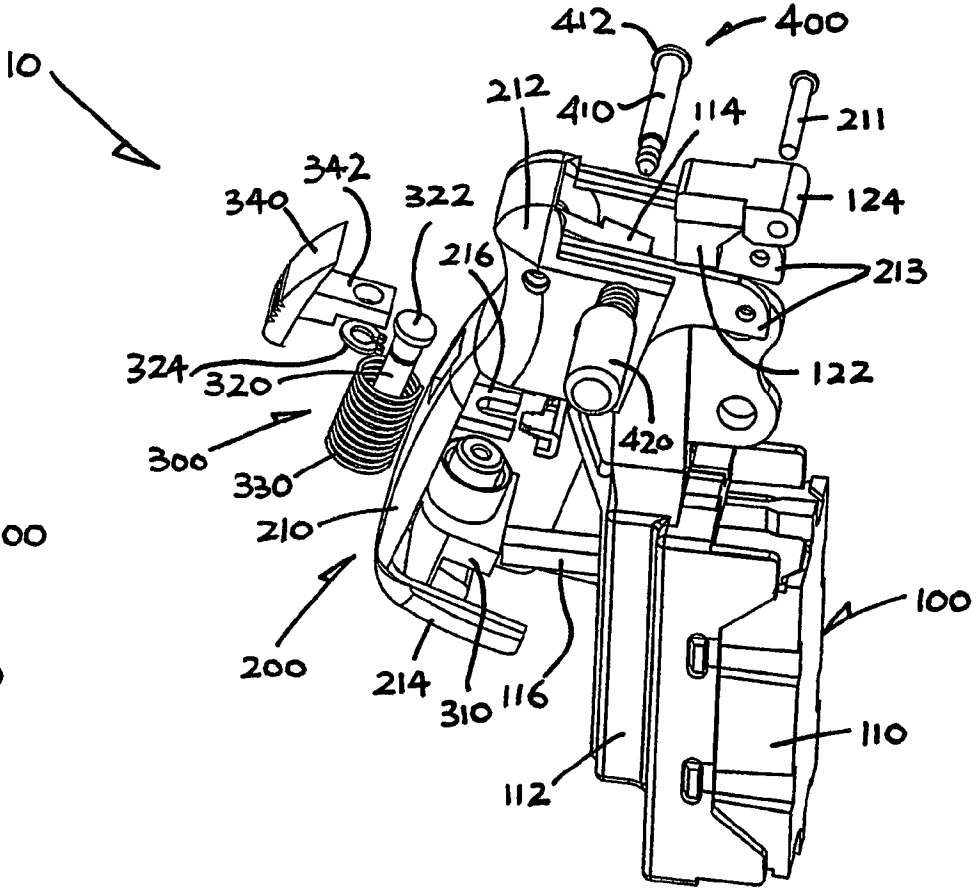
FIG. 2 is a partially broken away and exploded perspective view of the trigger assembly of FIG. 1.
Figure 1:
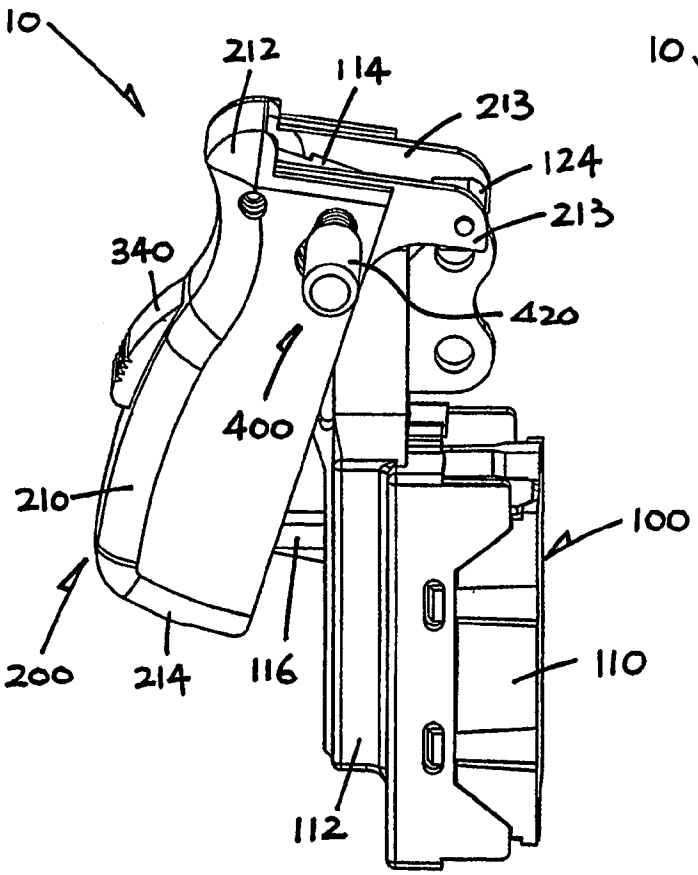
FIG. 1 is a perspective view of an embodiment of a trigger assembly embodying the invention, for operating an electric power tool.
Figure 3:
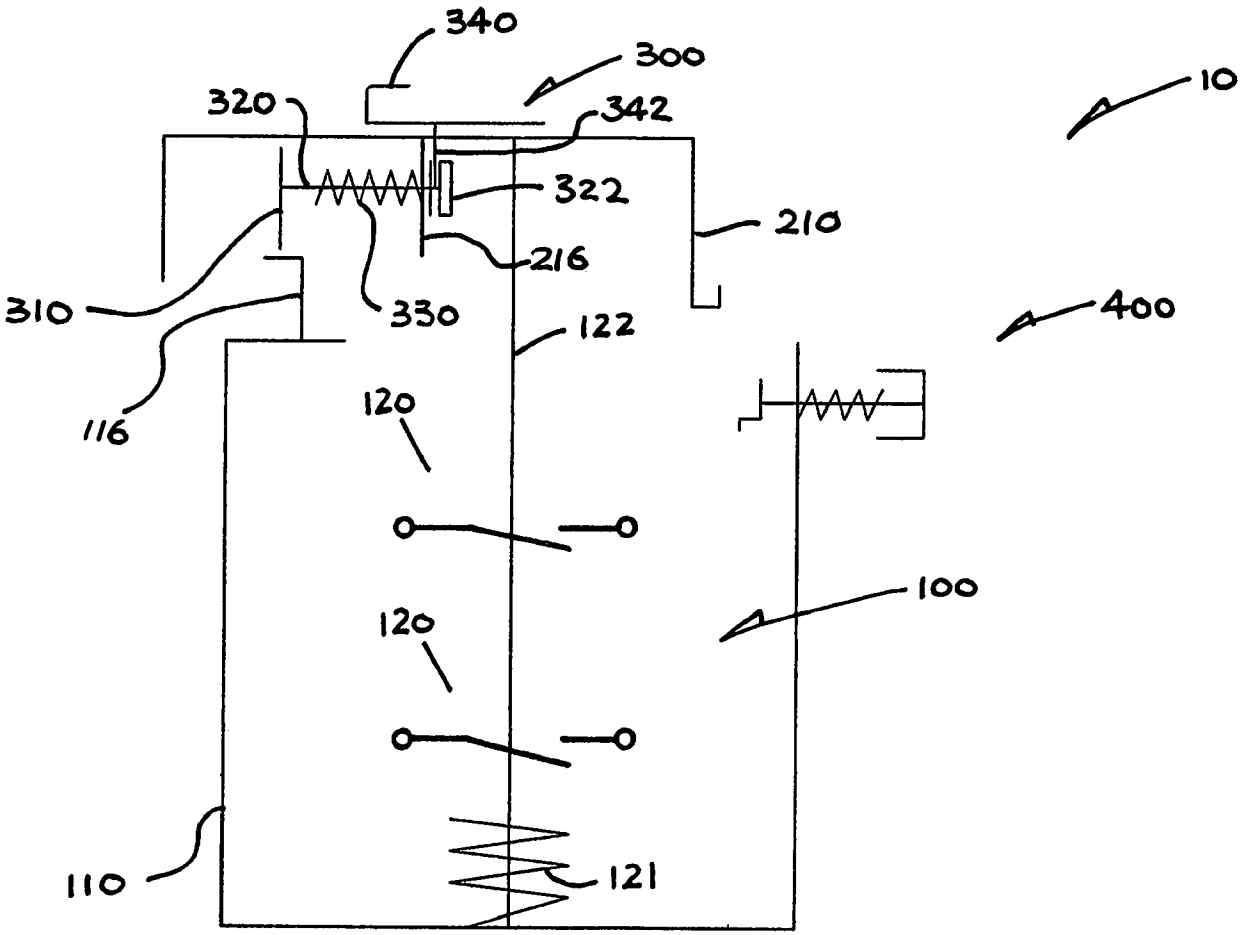
FIG. 3 is a schematic circuit diagram of the trigger assembly of FIG. 1.

Referring to the drawings, there is shown a trigger assembly 10 embodying the invention for controlling the operation of an electric power tool such as a hand drill that includes an electric motor. The trigger assembly 10 comprises a switch unit 100 and a trigger unit 200 located generally in front of and above the switch unit 100 for operating the same.

The switch unit 100 has an oblong vertical plastic casing 110 and includes a pair of internal switches 120 that are in use connected in series with the power tool motor, on opposite sides thereof, for turning on and off the motor. Alternatively, only one of the switches 120 may be used for the motor, with the other switch 120 for an auxiliary electronic/electrical device such as a battery or level meter.

The two switches 120 are operated by an elongate common actuator 122 to close and open in tandem. The actuator 122 is resiliently biassed downwards by an internal coil spring 121 such that both switches 120 are normally-open. The switch casing 110 is embraced, on its front side, by a plastic chassis 112 which slidably receives and supports the actuator 122 for relative upward and downward movement to operate the switches 120.

The chassis 112 and actuator 122 extend upwardly to their respective upper ends 114 and 124, where they are coupled with the trigger unit 200. Whilst the chassis end 114 turns to the front, the actuator end 124 is crooked to the rear. The chassis 112 includes a fixed projection 116 that sticks out to the front.

The trigger unit 200 has a shell-like plastic trigger 210 which is hinged at its upper end 212 to the upper end 114 of the chassis 112 for pivotal movement relative to the switch unit 100. The trigger end 212 has opposed walls reinforced by inner metal plates 213 including a pair of rear lugs that are connected to the actuator upper end 124 by a metal hinge pin 211.

By this hinged connection, the trigger 210 is pivotable inwardly, from an outer or OFF position (FIG. 4A or 4B) to an inner or ON position (FIG. 4C, 4D or 4E) thereof, upon pressing by the index, middle and ring fingers of a user's hand pulling the trigger 210 to thereby slide the actuator 122 upwards, counteracting the spring 121, and in turn close both switches 120. Under the action of the spring 121, the trigger 210 normally stays in the outer position, slopping outwardly.

The trigger unit 200 incorporates a locking device 300 for locking the trigger 210 in the OFF position, for safety reasons to prevent accidental depression or pulling of the trigger 210. The locking device 300 is provided and concealed inside a lower end 214 of the trigger 210, being supported and carried thereby. It is formed by a locking member 310, a connected vertical rod 320 upstanding therefrom, a compression coil spring 330 disposed on the rod 320, and a sliding knob 340 in engagement with the locking member 310 via the rod 320.

The sliding knob 340 has a horizontal stem 342 inserted through a vertical front slot into the trigger 210, where the stem 342 has an end hole through which the rod 320 is threaded downwardly for connection therewith. The rod 320 is retained with the knob stem 342 by an upper rod end 322 that is expanded, with a C-clip 324 fitted on the rod 320 immediately underneath the stem 342. The rod 320 is loosely supported at its end 322 below the knob stem 342 by a fork 216 through opposed prongs thereof, that fork 216 being an internal fixed part of the trigger 210.

The spring 330 co-acts between the fork 216 and the locking member 310 to thereby resiliently bias the locking member 310 downwards into a locking position (FIG. 4A) adjacent the projection 116 on the switch casing 110. In this position, the locking member 310 is aligned with and abuts the projection 116 or is blocked or obstructed, whereby the trigger 210 is locked in the OFF position and the electric drill cannot be switched on unintentionally.

The knob 340 is located about halfway up the front outer surface of the trigger 210, at a position that can conveniently be accessed or manipulated by the index finger of the user's hand operating the trigger 210, for momentarily sliding the knob 340 upwards against the action of the spring 330 to an unlocking position (FIG. 4B). In this position, the locking member 310 is displaced upwardly from and thus avoids the projection 116, whereby the trigger 210 is released and can be then pressed to the ON position (FIG. 4C) for switching on the drill.

The trigger unit 200 further includes a separate locking device 400 for locking the trigger 210 in the ON position, which is provided at the upper end 212 of the trigger 210. The locking device 400 comprises a spring-loaded locking pin 410 with press knob 420, which extends laterally from left to right through the trigger end 212 and in particular its left wall and metal plate 213 and the chassis end 114 (FIG. 5A), falling short of the right wall and metal plate 213. The locking pin 410 is located by the chassis end 114, relative to which the trigger end walls and plates 213 are pivotable as the trigger 210 is pulled and released.

When the trigger 210 is pulled back, there will be aligned a hole on the right metal plate 213, whereupon the locking pin 410 can be pressed further inward by the knob 420 to have its widened flat end 412 engage with this hole. Then the trigger 210 is locked in the ON position (FIG. 5B). The trigger 210 can be released for self return to the OFF position by momentarily pulling it slightly further back (FIG. 5C), whereupon the widened flat end 412 is released and the locking pin 410 springs back. As the locking device 400 is of the type not uncommonly known, it will not be described in greater detail herein.

It is envisaged that the release knob 340 may take any other suitable form such as a press button that protrudes downwardly from the lower end 214 of the trigger 210, in which case the button can conveniently be pressed by the small or ring finger of the user's hand operating the trigger 210.

The subject invention is especially, but not exclusively, applicable to trigger mechanisms of the type concerned, i.e. those designed for pulling by three fingers instead of the index finger alone, as the lock-off device is inevitably subject to a relatively larger trigger pulling force. By locating the lock-off device at or near the free end of the trigger in the broad sense, the force or torque it needs to withstand is minimized.

The invention has been given by way of example only, and various other modifications of and/or alterations to the described embodiments may be made by persons skilled in the art without departing from the scope of the invention as specified in the appended claims.

What is claimed is:

1. A trigger assembly for an electrical power tool, comprising:

a switch for electrical connection to a power tool for controlling operation of the power tool;

a trigger coupled with the switch for operating the switch, the trigger having a trigger surface for engagement by a finger for actuating the trigger and extending between first and second ends of the trigger, the trigger being pivotable about the first end between an outer position, in which the switch is open, and an inner position, in which the switch is closed; and a locking member located adjacent the second end of the trigger for locking the trigger in the outer position, the locking member including a knob supported on the trigger surface and movable from a locking position, locking the trigger in the outer position, to an unlocking position, releasing the trigger.

2. The trigger assembly as claimed in claim 1, wherein part of the locking member is located inside the trigger, proximate the second end.

3. The trigger assembly as claimed in claim 1, wherein the locking member is carried by the second end of the trigger.

4. The trigger assembly as claimed in claim 1, including a spring located inside the trigger at the second end and resiliently biasing the locking member into the locking position.

5. The trigger assembly as claimed in claim 4, including a rod connecting the knob to the locking member, wherein the spring is disposed on the rod.

6. The trigger assembly as claimed in claim 1, wherein the knob is slidably supported on the trigger surface.

7. A trigger assembly for an electrical power tool, comprising:

a switch for electrical connection to a power tool for controlling operation of the power tool;

a trigger coupled with the switch for operating the switch, the trigger having a surface for engagement by a finger for actuating the trigger and extending between first and second ends of the trigger, the trigger being pivotable about the first end between an outer position, in which the switch is open, and an inner position, in which the switch is closed;

a locking member located adjacent the second end of the trigger for locking the trigger in the outer position, the locking member being movable from a locking position, locking the trigger in the outer position, to an unlocking position, releasing the trigger; and a fixture comprising a part of a casing of the switch and abutting the locking member in the locking position to lock the trigger in the outer position, the locking member being manually movable to the unlocking position to avoid the fixture.

8. The trigger assembly as claimed in claim 7, wherein the fixture comprises a projection substantially aligned with the locking member when the locking member is in the locking position.

9. A trigger assembly for an electrical power tool, comprising:

a switch for electrical connection to a power tool for controlling operation of the power tool;

a trigger coupled with the switch for operating the switch, the trigger having a surface for engagement by a finger for actuating the trigger and extending between first and second ends of the trigger, the trigger being pivotable about the first end between an outer position, in which the switch is open, and an inner position, in which the switch is closed;

a locking member located adjacent the second end of the trigger for locking the trigger in the outer position, the locking member being movable from a locking position, locking the trigger in the outer position, to an unlocking position, releasing the trigger; and a separate releasable locking member located adjacent the first end of the trigger for locking the trigger in the inner position.

* * * * *